US006226487B1

(12) United States Patent
Yamashita et al.

(10) Patent No.: US 6,226,487 B1
(45) Date of Patent: May 1, 2001

(54) TRANSFER AND FIXING DEVICE HAVING SPECIFIC NIP RATIO

(75) Inventors: Takayuki Yamashita; Tsukasa Matsuda; Yuichi Fukuda; Tetsuo Yamada, all of Nakai (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/388,357

(22) Filed: Sep. 1, 1999

(30) Foreign Application Priority Data

Oct. 21, 1998 (JP) ..... 10-299864

(51) Int. Cl.[7] ..... G03G 15/16
(52) U.S. Cl. ..... 399/307
(58) Field of Search ..... 399/307, 331, 399/333, 328; 219/216

(56) References Cited

U.S. PATENT DOCUMENTS

| | | | | |
|---|---|---|---|---|
| 2,990,278 | | 6/1961 | Carlson . | |
| 3,884,623 | * | 5/1975 | Slack . | |
| 3,999,038 | * | 12/1976 | Sikes, Jr. et al. . | |
| 5,084,738 | * | 1/1992 | Ishikawa | 399/329 |
| 5,111,249 | * | 5/1992 | Owada | 399/69 |
| 5,450,181 | * | 9/1995 | Tsukida et al. . | |
| 5,546,175 | * | 8/1996 | Uehara et al. | 399/328 |
| 5,689,789 | * | 11/1997 | Moser . | |
| 5,890,043 | * | 5/1999 | Uehara . | |
| 6,064,849 | * | 5/2000 | Honda et al. | 399/302 |

FOREIGN PATENT DOCUMENTS

| | | | |
|---|---|---|---|
| 56-149076 | * | 11/1981 | (JP) . |
| 62-095571 | * | 5/1987 | (JP) . |
| 4-274473 | * | 9/1992 | (JP) . |
| 5-19642 | | 1/1993 | (JP) . |
| 5-107950 | | 4/1993 | (JP) . |
| 5-249798 | | 9/1993 | (JP) . |
| 8-146806 | | 6/1996 | (JP) . |

* cited by examiner

*Primary Examiner*—Robert Beatty
(74) *Attorney, Agent, or Firm*—Oliff & Berridge, PLC

(57) ABSTRACT

The present invention provides an image forming apparatus which adopts a simultaneous transfer and fixing method and is capable of obtaining a high-grade image which has high luster, a favorable balance of color and an excellent transparency. In an image forming apparatus provided with a transfer and fixing device which includes a heating roller and a pressure roller for transferring and fixing a toner image on an intermediate transfer body to a recording medium, the transferring and fixing operation is carried out using the heating roller and the pressure roller under a condition that the ratio a/b between the length a of a nip region N of the heating roller and the pressure roller in a direction A at the central portion of these rollers extending in a roller axial direction and the length b of the nip region N in the direction A at both ends of these rollers extending in the roller axial direction is set to be more than 0.8.

20 Claims, 13 Drawing Sheets

TRANSFER AND FIXING DEVICE HAVING SPECIFIC NIP RATIO

BACKGROUND OF THE INVENTION

1. Field of the Invention

The present invention relates to a transfer and fixing device, an image forming apparatus using the transfer and fixing device and an image forming method using the image forming apparatus which are used for a printer or a copying machine using an electrophotographic method.

2. Description of the Prior Art

Conventionally, image forming apparatuses which are capable of forming an electrostatic latent image on a photosensitive body, and developing the image using a dry toner and thereafter electrostatically transferring and fixing a toner image on a recording medium have been popularly used. In such image forming apparatuses, because of irregularities of the surface of a paper which constitutes a recording medium, the paper and the photosensitive body do not completely come into contact with each other and an uneven or irregular gap is formed between the paper and the photosensitive body and hence, a transfer electric field is disturbed or Coulomb repulsion occurs between toners thus disturbing the image.

To cope with such a problem, there have been proposed an image forming apparatus which is capable of forming a multiple toner image of the multicolor by eletrostatically overlapping and transferring plurality of toner images to an intermediate transfer body of an endless belt shape, and fusing the multiple toner image on the intermediate transfer body and thereafter simultaneously transferring and fixing the fused multiple toner image to a recording medium so as to obtain a color copy, and an image forming apparatus which is capable of fusing a multiple toner image of the multicolor which is formed on a photosensitive body having an endless belt shape and thereafter simultaneously transferring and fixing the fused multiple toner image to a recording medium so as to obtain a color copy. These color image forming apparatuses which are capable of transferring and fixing simultaneously have an advantage that the transfer of the toner image to the recording medium is performed non-electrostatically and hence, the previously mentioned degrading of image caused by the electrostatic image transfer hardly occurs.

As an improvement of this image forming apparatus, Japanese Patent laid-open No. 19642/1993, Japanese Patent laid-open No. 107950/1993 and Japanese Patent laid-open No. 249798/1993 and the like disclose a method where for further improving the transferability of a toner image formed on the surface of an intermediate transfer body having an endless belt shape or a photosensitive body to a recording medium, the intermediate transfer body or the photosensitive body carrying the toner image and a paper are heated or pressed under a condition that they are closely brought into contact with each other, and thereafter, the toner image is cooled and solidified while holding the intermediate transfer body or the photosensitive body and the recording medium in an overlapped manner, and then, the recording medium to which the toner image is transferred and fixed is peeled off from the intermediate transfer body or the photosensitive body.

In the image forming apparatus adopting the above method, when the cohesion between toners becomes greater than the adhering force between the toner and the medium, the toner image is peeled off from the intermediate transfer body or the photosensitive body and hence, the occurrence of a so-called offset which remains a part of the toner image on the intermediate transfer body or the photosensitive body can be prevented. Accordingly, it becomes possible for the image forming apparatus to require no oil and the transferring efficiency of the toner is enhanced thus achieving a favorable color balance of the image. Still furthermore, by using the intermediate transfer body or the photosensitive body having a smooth surface and solidifying the toner image by way of such a smooth surface, a high quality image which is excellent in luster and transparency of the toner and thus exhibits a high-grade feeling can be obtained.

In the image forming apparatus adopting the above method, however, a large number of wrinkles or creases are formed on the recording medium parallel to a recording medium transferring direction after heating and pressing operations by the transfer and fixing device and it gives rise to a phenomenon that the toner image is partially peeled off from the intermediate transfer body or the photosensitive body before the toner image is cooled and solidified. When this phenomenon occurs, in addition to the occurrence of wrinkles on the recording medium, the image quality is remarkably degraded.

FIG. 9(*a*) is a plane view showing the condition where the wrinkles are generated on the recording medium after heating and pressing using a conventional transfer and fixing device and FIG. 9(*b*) is a cross-sectional view taken along a line B—B of FIG. 9(*a*).

As shown in FIG. 9(*a*), a large number of wrinkles 9 may occur in parallel to the recording medium conveying direction A on the recording medium P after heating and pressing using the conventional transferring and fixing device. When the wrinkles 9 occur, as shown in FIG. 9(*b*), the recording medium P is peeled off from the intermediate transfer body 1 before the toner image t is cooled and solidified and the toner image t is partially solidified under a condition that a part of the toner image t is not closely brought into contact with the intermediate transfer body 1. Accordingly, the surface of the solidified toner image t is formed in an irregular condition where low luster portions C and high luster portions D are present in a mixed form thus the glossiness of the image is lowered and the image quality is drastically degraded.

The wrinkles which are parallel to the recording medium conveying direction A also occur in the conventional fixing device which adopts a roller method. In such a fixing device, as disclosed in Japanese Patent laid-open No. 146806/1996, for example, a nip width at both roller axial direction end portions of a nip region where a pair of fixing rollers press each other is set to be wider than the nip width at the roller axial central portion and hence, the occurrence of wrinkles can be restricted.

FIG. 10 is a schematic view showing the nip region defined by a pair of rollers having resilient body layers respectively.

As shown in FIG. 10, in the nip region N where a heating roller 2 and a pressure roller 3 which are mounted in the fixing device press each other, a resilient layer 3*a* which is formed on the surface of the pressure roller 3 is subjected to a compressive deformation. When a pair of rollers 2, 3 are rotated in a C direction and a D direction respectively under this condition, to maintain the steady state, a resilient body having the same weight must pass through a portion A (a portion hatched in a rightward and upward direction) which is subjected to the compressive deformation and a portion B (a portion hatched in a leftward and downward direction) which is not subjected to the compressive deformation.

Accordingly, the circumferential speed of the portion A where the cross-sectional area thereof is reduced due to the compressive deformation is greater than the circumferential speed of the portion B. Especially, at the portion A, as the part thereof comes closer to the surface of the layer, an amount of increase of the circumferential speed becomes greater. The amount of increase of the circumfereatial speed depends on the magnitude of the compressive deformation and becomes greater as an amount of deformation is increased.

FIG. 11 is a schematic view showing the principle for preventing wrinkles in a conventional fixing device.

As shown in FIG. 11, in a conventional fixing device which adopts a roller method, usually, a heating roller 2 and a pressure roller 3 make their respective roller axial end portions thereof have larger diameter than the diameter of the central portions thereof and hence, an amount of compressive deformation of the rollers at the respective roller axial end portions thereof are made large while an amount of compressive deformation of the rollers at the central portions thereof are made small. Accordingly, the circumferential speed S2 of a recording medium P in the vicinity of both end portions of the nip region is made faster than the circumferential speed S1 of the recording medium P in the vicinity of the central portion of the nip region. Therefore, before entering the nip region, in the vicinity of the roller axial central portion of the recording medium P, a large resisting force R1 which is directed in a direction opposite to a recording medium conveying direction A occurs and a small resisting force R2 occurs in the vicinity of the roller axial end portions. As a result, a moment M directed outwardly works on the recording medium P before it enters the nip region and then the recording medium P enters the nip region while being stretched laterally and hence, no wrinkle occurs on the recording medium P.

In this manner, as described above, the conventional fixing device restricts the occurrence of wrinkles by making the nip width at both roller axial end portions of the nip region where a pair of rollers 2, 3 press each other wider than the nip width at the roller axial central portion.

However, in the image forming apparatus adopting a simultaneous transferring and fixing method, at the time of heating and pressing, in case the length of nip region in a recording medium conveying direction at both roller axial direction end portions of a pair of rollers is made wider than the length of the nip region in a recording medium conveying direction at the roller axial central portion, that is, in case a roller having a construction similar to that of the fixing device shown in FIG. 11 is used, it is impossible to restrict the occurrence of wrinkles which are parallel to the above-mentioned recording medium conveying direction and rather worsens the situation and hence, the image of high quality cannot be obtained.

FIG. 12 is a schematic view showing the conventional image forming apparatus adopting the simultaneous transferring and fixing method.

As shown in FIG. 12, this image forming apparatus comprises an image reading device 30 which reads image information, an image processing device 40 which processes the read image information, an intermediate transfer body 1 which is an image carrier of an endless belt shape capable of carrying out a circulation movement in an arrow direction A, a toner image forming device which includes photosensitive bodies 4_1, 4_2, 4_3, 4_4 which are respectively registered to black, yellow, magenta, and cyan, a light beam scanning device 20 which forms toner images on respective photosensitive bodies 4_1, 4_2, 4_3, 4_4 based on the image information, and developers 11_1, 11_2, 11_3, 11_4 which store toners of black, yellow, Magenta and cyan, transfer devices 15_1, 15_2, 15_3, 15_4 which transfer toner images formed on the photosensitive bodies 4_1, 4_2, 4_3, 4_4 to the intermediate transfer body 1, a heating part H which fuses the toner images formed on the intermediate transfer body 1, a transfer and fixing device T which simultaneously transfers and fixes the toner images formed on the intermediate transfer body 1 to a recording medium P supplied from a tray 6, a cooler 7 which cools and solidifies the toner image, rollers 5_1, 5_2 which supports the intermediate transfer body 1, a tension roller 5_3 which gives a given tension force to the intermediate transfer body 1, and a peeling-off roller 5_4 which peels off the recording medium P from the intermediate transfer body 1.

The transfer and fixing device T includes a heating roller 2 and a pressure roller 3 and these two rollers heat and pressurize the intermediate transfer body 1, the toner image and the recording medium P at a nip region where these two rollers press each other. In the transfer and fixing device T, the intermediate transfer body 1, the toner image and the recording medium P are joined and are heated and pressurized in a closely contacted condition, and powdery toner is formed in a fused condition and respective toner particles are fused to form a sheet of film. Here, for assuring an efficient heat transfer to the toner image, the intermediate transfer body 1 and the recording medium P must be closely brought into contact with each other. If the contact is insufficient and air infiltrates into some places, the heat capacity varies depending on the places where air is present and the places where air is not present so that the toner image is not uniformly fused thus giving rise to irregularities on transfer and fixing or a so-called offset phenomenon and eventually the deterioration of the image quality. To enhance the degree of close contact between the intermediate transfer body 1 and the recording medium P while sandwiching the toner image therebetween, a resilient body layer is formed on the intermediate transfer body 1. Furthermore, the heating roller 2 and the pressure roller 3 are also provided with resilient body layer on the surface thereof for assuring an application of uniform pressure.

FIG. 13 is a schematic view showing the manner how wrinkles occur on a recording medium in an image forming apparatus which adopts a conventional synchronous transfer and fixing method.

Usually, the heating roller 2 and the pressure roller 3 have both respective roller axial end portions thereof supported and hence, when the rollers press each other, portions of these rollers located in the vicinity of the central portions of these rollers are deflected in directions away from each other so that the width of the nip region located in the vicinity of the roller end portions is made wider than the width of the nip region located in the vicinity of the central portions the rollers. That is, an amount of compressive deformation in the vicinity of both roller end portions is greater than an amount of compressive deformation in the vicinity of the central portions of the rollers. Accordingly, the circumferential speed S2 of the recording medium P and the intermediate transfer body 1 in the vicinity of the both roller end portions becomes faster than the circumferential speed S1 of the central portion of the roller. However, the intermediate transfer body 1 is an endless belt and is given a tension by means of a tension roller 5_3 and hence, it receives the least influence from the speed distribution within the nip region due to the compressive deformation of the resilient body layer formed at the roller surface. Furthermore, as in the case of previously mentioned fixing device adopting the roller method (see FIG. 11), the recording medium P receives a moment M directed outwardly before entering the nip region and thereafter enters the nip region while being stretched laterally. However, after passing through the nip region, the portions located in the vicinity of both end portions pass through the nip region much faster than the central portion and hence, the recording medium P receives a moment M' directed inwardly. As a result, a part of the recording medium P is peeled off from the intermediate transfer body 1 and hence, wrinkles occur and uneven brightness of the image are brought about.

The present invention has been made in view of the above drawbacks and it is an object of the present invention to provide an image forming apparatus which adopts a simultaneous transfer and fixing method and is capable of obtaining a high-grade image which has high luster, a favorable balance of color, and an excellent transparency of toner, a transfer and fixing device used for the image forming apparatus, and an image forming method which is capable of forming a high-grade image using the above-mentioned image forming apparatus.

SUMMARY OF THE INVENTION

The first image forming apparatus of the present invention for achieving the above object is an image forming apparatus which comprises an image carrier of an endless belt shape which carries out a circulation movement in a determined moving direction, a toner image forming device for forming a toner image on the image carrier, and a transfer and fixing device which includes a pair of pressure members and overlaps the toner image formed on the image carrier and a given recording medium and then presses them while heating thus transferring and fixing the toner image on the image carrier to the recording medium, wherein the improvement is characterized in that in a nip region where the above-mentioned pair of pressure members press each other, the ratio a/b between the length a of the nip region in an image carrier moving direction at the central portions of a pair of pressure members extending in a direction which intersects the image carrier moving direction and the length b of the nip region in the image carrier moving direction at both end portions of the pressure members extending in the direction which intersects the above-mentioned moving direction is set to equal to or more than 0.8.

The second image forming apparatus of the present invention for achieving the above object is an image forming apparatus which comprises a photosensitive body of an endless belt shape which carries out a circulation movement in a determined moving direction, an electrostatic latent image forming device which forms an electrostatic latent image on the photosensitive body based on image information, a developing device for forming a toner image on the photosensitive body by developing the electrostatic latent image with a toner, and a transfer and fixing device which includes a pair of pressure members and overlaps the photosensitive body which carries the toner image formed by the developing device and a given recording medium and presses them while heating thus transferring and fixing the toner image on the photosensitive body to the recording medium, wherein the improvement is characterized in that in a nip region where the above-mentioned pair of pressure members press each other, the ratio a/b between the length a of the nip region in a photosensitive body moving direction at the central portions of the pressure members extending in a direction which intersects the photosensitive body moving direction and the length b of the nip region in the photosensitive body moving direction at both end portions of the pressure members extending in the direction which intersects the above-mentioned moving direction is set to equal to or more than 0.8.

The image forming method of the present invention for achieving the above object is an image forming method comprising a toner image forming step in which a toner image is formed on an endless belt which holds the toner image on a surface thereof and carries out a circulation movement in a determined direction and a transfer and fixing step in which using a transfer device equipped with a pair of pressure members, the toner image formed on the endless belt and a given recording medium are overlapped and pressed to each other while being heated so as to transfer and fix the toner image on the endless belt to the recording medium, wherein the transfer and fixing step is a step in which the transfer and fixing are carried out using a pair of pressure members in such a manner that as a pair of pressure members, a pair of transfer members which are capable of setting the ratio a/b between a length a in the moving direction of a nip region where a pair of pressure members press each other at the central portion of the pressure members extending in a direction intersecting the moving direction and a length b in the moving direction of the nip region at both end portions of the pressure members extending in the direction which intersects the moving direction is set to equal to or more than 0.8.

DETAILED DESCRIPTION OF THE INVENTION

The embodiments of the present invention are hereinafter explained.

Figure 1:
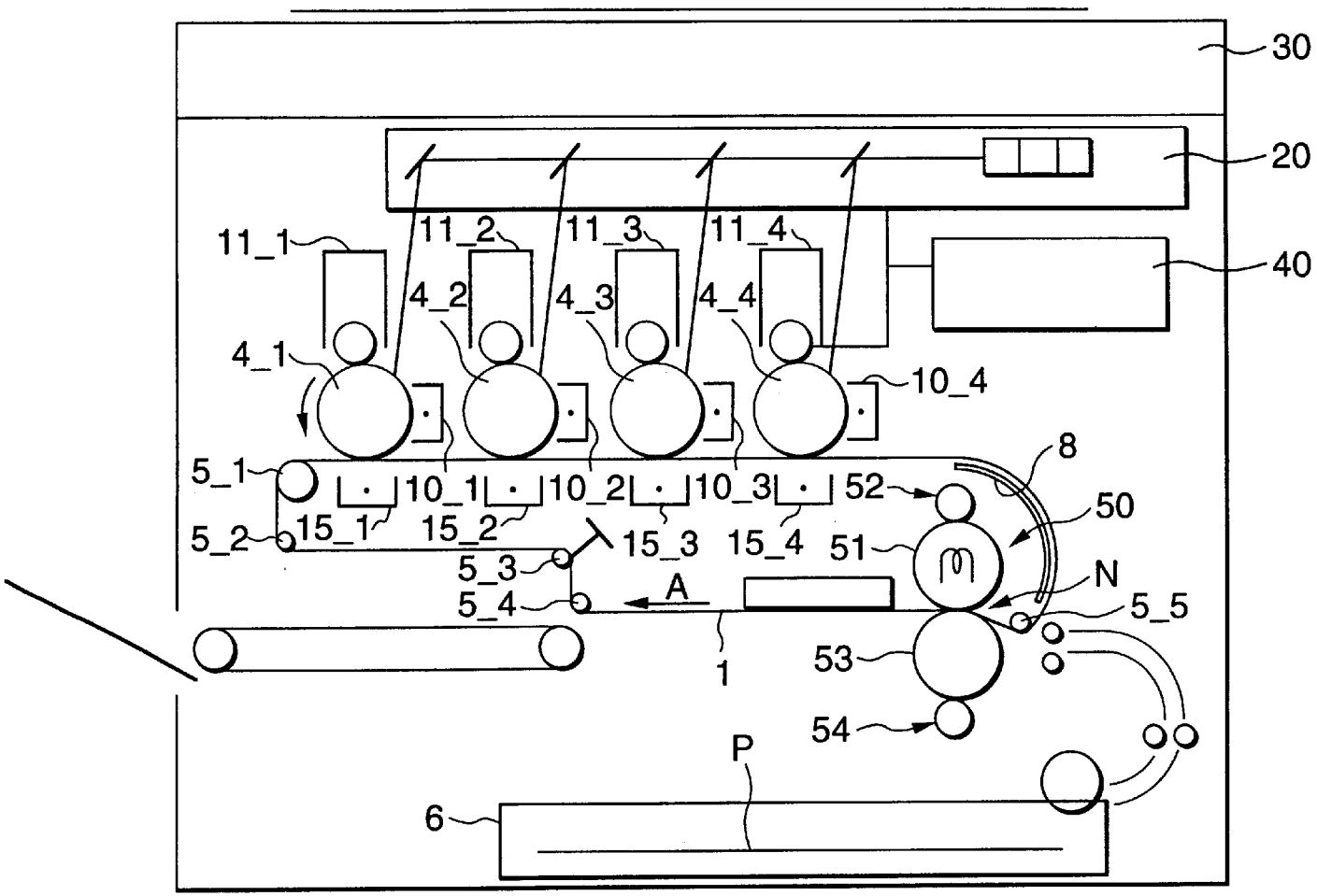
FIG. 1 is a schematic structural view of one embodiment of the first image forming apparatus of the present invention.

FIG. 1 is a schematic structural view showing one embodiment of the first image forming apparatus of the present invention.

As shown in FIG. 1, this image forming apparatus comprises an image reading device 30 which reads image information, an image processing device 40 which processes the read image information, an intermediate transfer body 1 which is an image carrier of an endless belt shape capable of carrying out a circulation movement in an arrow direction A, a toner image forming device which includes photosensitive drums 4_1, 4_2, 4_3, 4_4 which are respectively registered to black, yellow, magenta, and cyan, a light beam scanning device 20, charging devices 10_1, 10_2, 10_3, 10_4 and developers 11_1, 11_2, 11_3, 11_4 which store toners of black, yellow, magenta and cyan, transfer devices 15_1, 15_2, 15_3, 15_4 which transfer toner images formed on the photosensitive drums 4_1, 4_2, 4_3, 4_4 to the intermediate transfer body 1, a heater plate 8 which heats the toner images formed on the intermediate transfer body 1, a transfer and fixing device 50 which simultaneously transfer and fix the toner images formed on the intermediate transfer body 1 to a recording medium P supplied from a tray 6 by overlapping the recording medium P and the toner images on the intermediate transfer body 1 by pressing while heating, a cooler 7 which cools and solidifies the toner image, a tension roller 5_3 which gives a given tension to the intermediate transfer body 1, and a peeling-off roller 5_4 which peels off the recording medium P from the intermediate transfer body 1, and rollers 5_1, 5_2, 5_5 for supporting the intermediate transfer body 1.

The transfer and fixing device 50 includes a heating roller 51 and a pressure roller 53 and these rollers 51, 53 heat and press the intermediate transfer body 1, the toner image and the recording medium P at a nip region where these two rollers press each other. The heating roller 51 and the pressure roller 53 may be arranged such that they change their respective positions each other. Furthermore, a heat source may be installed in the inside of the pressure roller 53 so as to construct a heating and pressure roller. The heater plate 8 is constructed by a plate-like member stored in the heat source.

The heating roller 51 and the pressure roller 53 of this embodiment constitute a pair of pressure members of the present invention. Although a pair of pressure rollers according to the present invention may be constructed by a pair of rollers as in the case of this embodiment, they may be constructed by a pair of plate-like members or may be constructed by a combination of a roller and a plate-like member.

As the heating roller 51 and the pressure roller 53 of the first embodiment, metallic rollers or rollers on which heat-resistant resilient layers made of silicone rubber or the like are formed can be used. Inside the heating roller 51, a heat source is disposed and its heating temperature is controlled such that the toner temperature at a nip region N is equal to or more than the toner melting temperature (Tm).

As shown in FIG. 1, the heating roller 51 and the pressure roller 53 of the image forming apparatus are respectively provided with pressing devices 52, 54.

Figure 2:
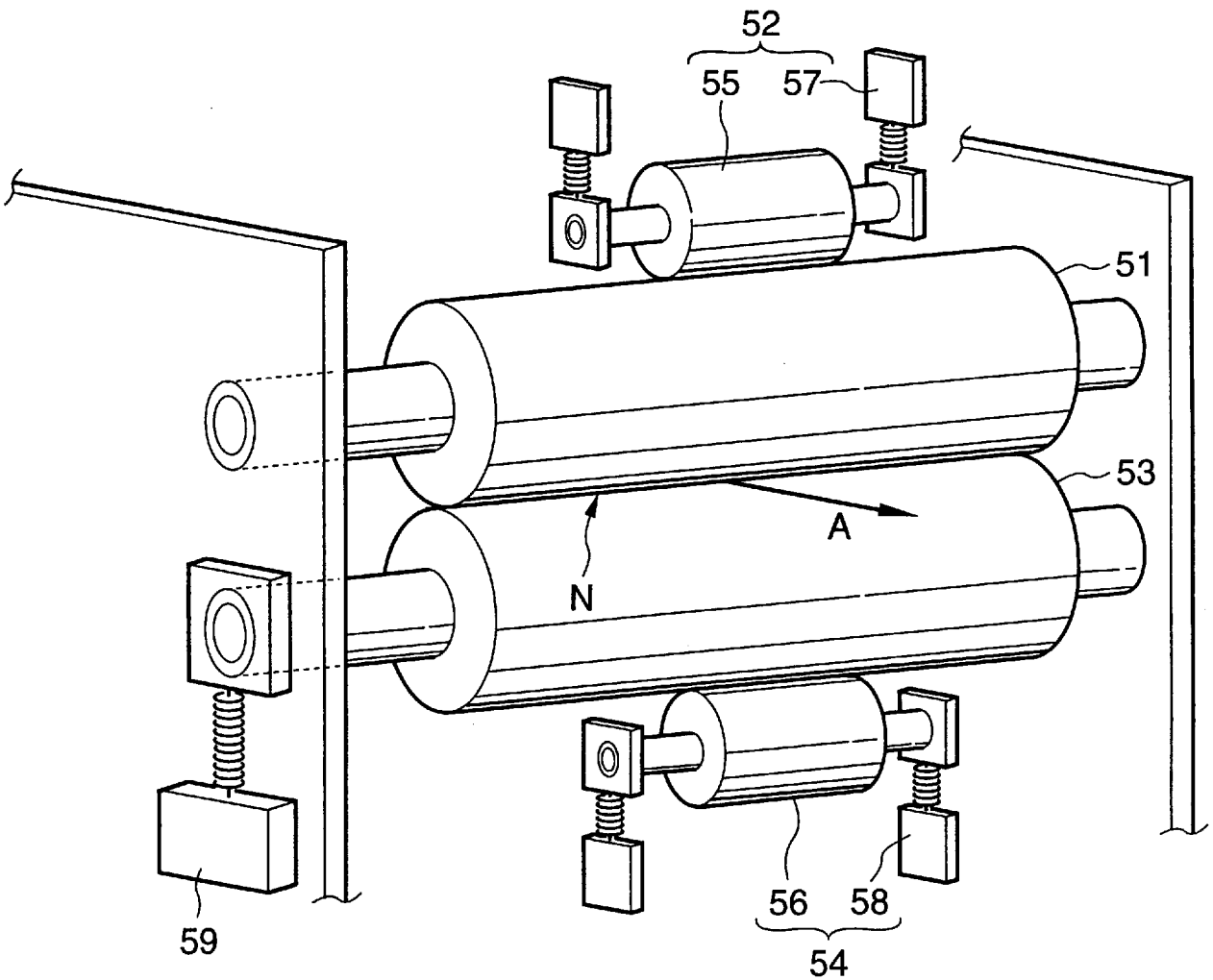
FIG. 2 is a schematic view of a pressing device of the first embodiment.

FIG. 2 is a schematic view showing the pressing devices of the first embodiment.

As shown in FIG. 2, with respect to the heating roller 51 and the pressure roller 53 which constitute a pair of pressure members, the pressing devices 52, 54 are provided for pressing the central portion of one pressure member in a direction to intersect the moving direction A of the intermediate transfer body 1 toward the other pressure member from the side opposite to the side which comes into contact with the other pressure member. The pressing devices 52, 54 respectively consist of back-up rollers 55, 56 and pressing units 57, 58 which press the back-up roller 55, 56 to the heating roller 51 and the pressure roller 53.

A determined roller load is applied to the pressure roller 53 toward the heater roller 51 by means of a pressure applying unit 59 and the nip region N is defined between the heating roller 51 and the pressure roller 53 due to such a roller load.

Figure 3B:
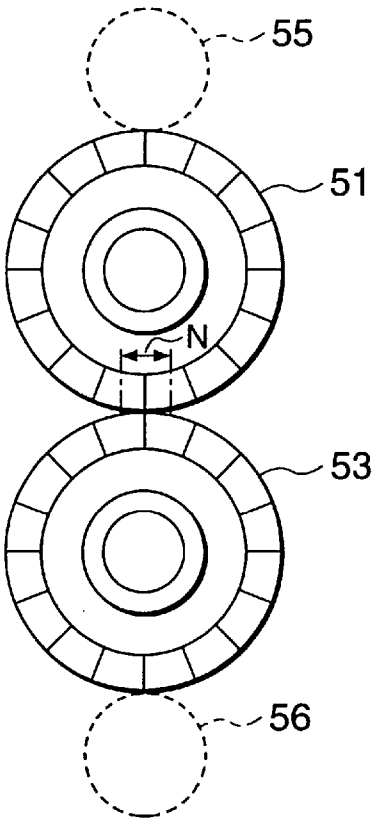
FIGS. 3(*a*)–3(*c*) are a perspective view, a side view of a pair of pressure members and a plane view of a nip region of the first embodiment, respectively.
Figure 3A:
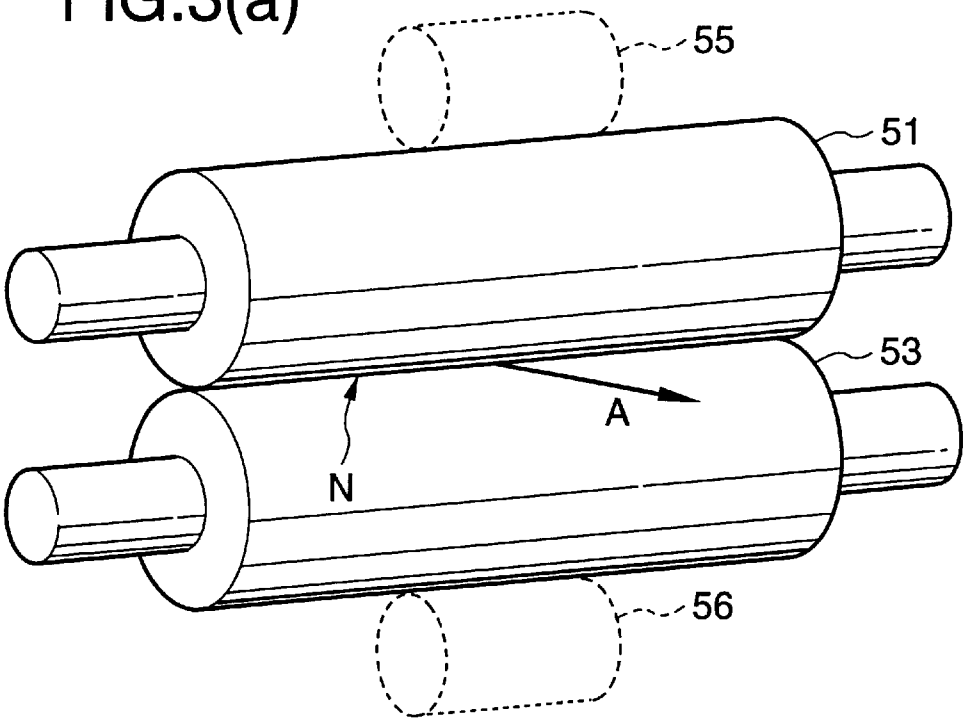
Figure 3C:
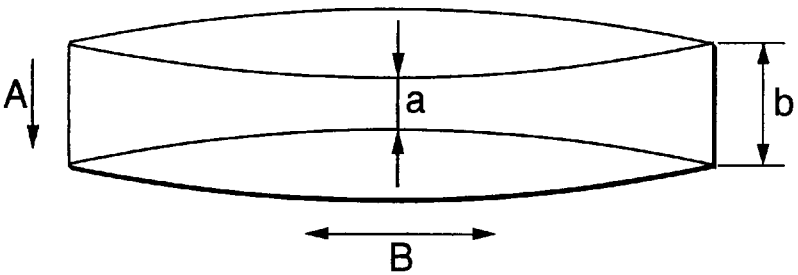

FIG. 3(*a*) is a perspective view of a pair of pressure members, FIG. 3(*b*) is a side view of a pair of pressure members, and FIG. 3(*c*) is a plan view of the nip region shown in FIG. 2.

As shown in FIG. 2, FIG. 3(*a*) and FIG. 3(*b*), in the first embodiment, the heating roller 51 and the pressure roller 53 are used as a pair of pressure members. By applying a given roller load to these pair of rollers using the pressing devices shown in FIG. 2 by way of the back up rollers 55, 56, the nip region N having the shape shown in FIG. 3(*c*) is formed. This nip region N is formed such that the ratio a/b (hereinafter referred to as nip shape index) between the length a of the nip region N in a moving direction A of the intermediate transfer body at the central portions of a pair of rollers extending in a direction B (roller axial direction) which intersects the moving direction A of the intermediate transfer body and the length b of the nip region N in the moving direction A of the intermediate body at both end portions of a pair of rollers extending in the direction B which intersects the moving direction A becomes equal to or more than 0.8.

The reason that the above nip shape index a/b is set to equal to or more than 0.8 in the present invention is explained in detail at the time of explanation of the experiment.

The image forming method using the image forming apparatus is explained in accordance with the sequential steps in view of FIG. 1.

In the first step, a toner image is formed. In this toner imager forming step, the photosensitive drums 4_1, 4_2, 4_3, 4_4 are uniformly charged by charging devices 10_1, 10_2, 10_3, 10_4 and thereafter, the photosensitive drums 4_1, 4_2, 4_3, 4_4 are exposed by means of the light scanning device 20 which is turned on or off by a light beam pulse width modulation device in response to a concentration signal outputted from the image signal processing device 40 based on the image information from the image reading device 30 so that electrostatic latent images which are registered to respective colors constituted by black, yellow, magenta, cyan can be formed on respective photosensitive drums. The electrostatic latent images formed on respective photosensitive drums are respectively developed by toners of respective colors stored in the developers 11_1, 11_2, 11_3, 11_4 and their concentration is expressed by the area modulation. That is, respective toner images which are made of so-called digital images are formed on the respective photosensitive drums. These respective toner images are transferred in sequence to the surface of the intermediate transfer body 1 having an endless belt shape which circulates in a moving direction shown by an arrow A by means of the transfer devices 15_1, 15_2, 15_3, 15_4 and a plurality of toner images in a plurality of colors are overlapped to form a multicolor toner image on the intermediate transfer body 1.

Subsequently, transfer and fixing are carried out as the second step. In this transfer and fixing step, the multicolor toner image formed on the intermediate transfer body 1 is brought into contact with the heating plate 8 and is fused. Simultaneous with the timing that the multicolor toner image is conveyed to the transfer and fixing device 50, the recording medium P is fed to the transfer and fixing device 50 from the tray 6. Prior to the timing that the multicolor toner image and the recording medium P reaches the transfer and fixing device 50, the pressure roller 53 moves from a standby position disposed away from the heating roller 51 to a pressing position so as to define the nip region N where the heating roller 51 and the pressure roller 53 which constitute a pair of pressure members press each other. When the intermediate transfer body 1 which carries the multicolor toner image and the recording medium P are fed to the nip region N in an overlapped position, the multicolor toner image on the intermediate transfer body 1 is heated at a temperature equal to or more than a melting temperature and thus is softened and fused, and thereafter is impregnated into the recording medium P and subsequently is cooled and solidified to carry out the transfer and the fixing. The nip region N defined by a pair of rollers 51, 53 is formed such that the ratio a/b (nip shape index) between the length a of the nip region N in the moving direction A at the central portion of the rollers 51, 53 extending in a direction (roller axial direction) which intersects the moving direction A and the length b of the nip region N in the moving direction A at both end portions of the rollers 51, 53 extending in a direction B which intersects the moving direction A becomes equal to or more than 0.8.

The multicolor toner image which is transferred and fixed to the recording medium P coheres and is solidified by the cooler 7 and it gives rise to a strong adhesive force between the multicolor toner image and the recording medium P. The intermediate transfer body 1 and the recording medium P which are cooled by the cooler 7 are transferred to peeling-off rollers 5_4 having a small radius of curvature and because of its strong rigidity of the recording medium per se, the recording medium P is peeled off from the intermediate transfer body 1 together with the toner to complete a color image. The surface of the toner image transferred and fixed to the recording medium P is smoothed following the surface of the intermediate transfer body 1 thus exhibiting high luster.

As the photosensitive drums 4_1, 4_2, 4_3, 4_4, various organic photosensitive bodies can be used besides various inorganic photosensitive bodies (Se, α-Si, α-SiC, CdS and the like).

The toner is composed of thermoplastic binders which contain various coloring matters such as yellow, magenta, cyan or the like and known material can be used as such a toner. In this embodiment, the toner having the mean weight molecular weight (MW) of 54000, the melting temperature (Tm) of 120° C., and the viscosity (η) of 4000 Pas at the melting temperature is used. The mean particle size of the toner is 7 μm. The exposure condition and the developing condition are set such that an amount of toner of respective color is set to fall in a range of 0.4 mg/cm$^2$–0.7 mg/cm$^2$ depending on the content of the coloring matter. In this embodiment, the amount of toner for each color is set to 0.65 mg/cm$^2$.

The intermediate transfer body 1 has a two layer construction made of a base layer and a surface layer.

The base layer is made of a polyimide film having a thickness of 70 μm which contains carbon black. In this embodiment, for carrying out the transfer of the toner image from the photosensitive drum to the intermediate transfer body electrostatically without any disturbance of the image, the volume resistivity of the base layer is adjusted to $10^{10}$ Ω.cm by varying an amount of addition of the carbon black. As the base layer, besides the polyimide film, a sheet having a thickness of 10–300 μm and a high heat resistance, such as a polymer sheet made of polyester, polyethylene terephthalate, polyether sulfon, polyether ketone, polysulfon, polyimide, polyamide can be used.

As the surface layer, its volume resistivity is adjusted to $10^{14}$ Ω.cm for carrying out the transfer of the toner image from the photosensitive drum to the intermediate transfder body electrostatically without any disturbance of the image. Furthermore, at the time of carrying out the transfer and fixing simultaneously from the intermediate transfer body to the paper, for enhancing the close contact between the intermediate transfer body and the paper while interposing the toner image therebetween, a silicone copolymer having a rubber hardness of 30 degree and a thickness of 50 μm is used. The silicone copolymer has a suitable resiliency and its surface has a stickiness to the toner at a normal temperature. Furthermore, the silicone copolymer has a characteristic that the fused and fluidized toner is liable to be peeled off. In this manner, the silicone copolymer has an advantage that it enhances the transfer efficiency of the toner to the recording medium so that it is an optimum material as the surface layer.

The heating plate 8 used in this embodiment is made of an aluminum plate having a thickness of 2 mm and a length of 220 mm in the moving direction A of the intermediate transfer body 1 and a silicone rubber heater adhered to the rear surface of the aluminum plate. The heating temperature is controlled such that the toner temperature at the nip region N where the intermediate transfer body 1 comes into contact with the recording medium P becomes equal to or more than the toner melting temperature (Tm). The heating plate 8 may be made of a ceramic heater or the like besides the above-mentioned material.

The image forming method of the present invention is hereinafter explained in view of experiments.

(First Experiment)

In this experiment, various rollers shown in Table 1 are used and an image forming test was carried out by changing the nip shape index a/b upon changing the roller load to various values.

In Table 1, the outer diameter of the central portions and both end portions of the heating roller 51 and the pressure roller 53 (see FIG. 3), the diameter of the central portion and both end portions of the metallic roller, the thickness and the hardness of the resilient body (rubber) layer, the roller load and the nip shape index a/b are shown.

The nip shape index a/b is the ratio a/b of the nip width b at both end portions in a roller axial direction relative to the nip width a of the central portion in the roller axial direction in the nip region N which is explained in conjunction with FIG. 3(*c*).

TABLE 1

| outer diameter of central portion of roller (mm) | outer diameter of both end portions of roller (mm) | outer diameter of central portion of metallic roller (mm) | outer diameter of both end portions of metallic roller (mm) | thickness (maximum) of resilient body layer (mm) | hardness of resilient body layer (JIS-A) | roller load (kgf) | nip shape index a/b |
|---|---|---|---|---|---|---|---|
| 50.0 | 50.0 | 48.0 | 48.0 | 1.0 | 30 | 80 | 0.83 |
| 50.0 | 50.0 | 46.0 | 46.0 | 2.0 | 30 | 80 | 0.9 |
| 50.0 | 50.0 | 48.0 | 48.0 | 1.0 | 45 | 80 | 0.76 |
| 50.0 | 50.0 | 46.0 | 46.0 | 2.0 | 45 | 80 | 0.86 |
| 50.0 | 50.0 | 48.0 | 47.3 | 1.0 | 30 | 80 | 0.89 |
| 50.0 | 50.0 | 46.0 | 45.3 | 2.0 | 30 | 80 | 0.93 |
| 50.0 | 50.0 | 48.0 | 47.3 | 1.0 | 45 | 80 | 0.85 |
| 50.0 | 50.0 | 46.0 | 45.3 | 2.0 | 45 | 80 | 0.88 |
| 30.0 | 30.0 | 26.0 | 26.0 | 2.0 | 30 | 70 | 0.63 |
| 30.0 | 30.0 | 26.0 | 26.0 | 2.0 | 30 | 80 | 0.61 |
| 30.0 | 29.6 | 26.0 | 26.0 | 2.0 | 30 | 70 | 0.89 |
| 30.0 | 29.6 | 26.0 | 26.0 | 2.0 | 30 | 80 | 0.82 |

With respect to the recording medium, J paper manufactured by Fuji Xerox Co., Ltd was used as an ordinary paper, S paper manufactured by Fuji Xerox Co., Ltd was used as a thin paper, and Shiraoi paper manufactured by Dai Showa Seishi Corporation was used as a thick paper. The measured values of mean thickness at ten points of J paper, S paper and Shiraoi paper were respectively around 96 $\mu$m, 76 $\mu$m and 210 $\mu$m. The screen was made of vertical wires and the number of wires was 200. The moving speed of the intermediate transfer body (transfer and fixing speed of toner image) was set to 260 mm/s.

Under the above-mentioned test condition, 100 sheets of J paper, S paper and Shiraoi paper were respectively outputted as image and evaluation was carried out on the paper wrinkles and uneven brightness.

The evaluation adopted following evaluation grades of three stages based on a naked eye judgement.

G0: Neither paper wrinkle nor uneven brightness occurred.

G1: Although some undulation was recognized on the recording medium, no uneven brightness occurred.

G2: Both paper wrinkle and uneven brightness occurred.

The allowable grade was set to equal to or below G1.

Figure 4:
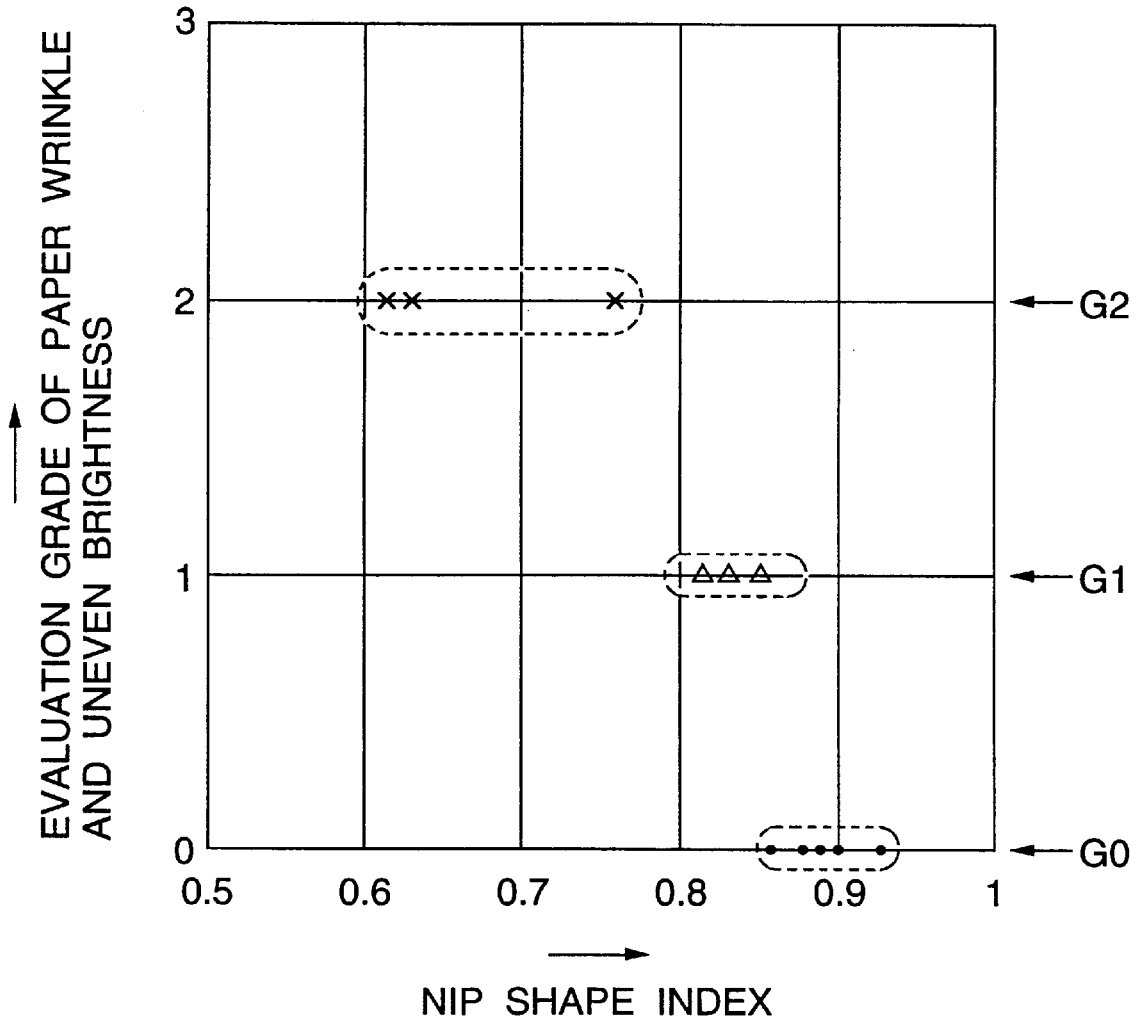
FIG. 4 is a graph showing the relationship between a nip shape index a/b and an evaluation grade on paper wrinkle and irregularities on luster under a testing condition shown in Table 1.

FIG. 4 is a graph showing the relationship between the nip shape index a/b and the evaluation grade on the paper wrinkle and uneven brightness under the condition shown in Table 1.

As shown in FIG. 4, in case the nip shape index a/b is approximately equal to or more than 0.8, the evaluation grade on paper wrinkle and uneven brightness which meets the allowable grade G1 can be obtained.

Figure 13:
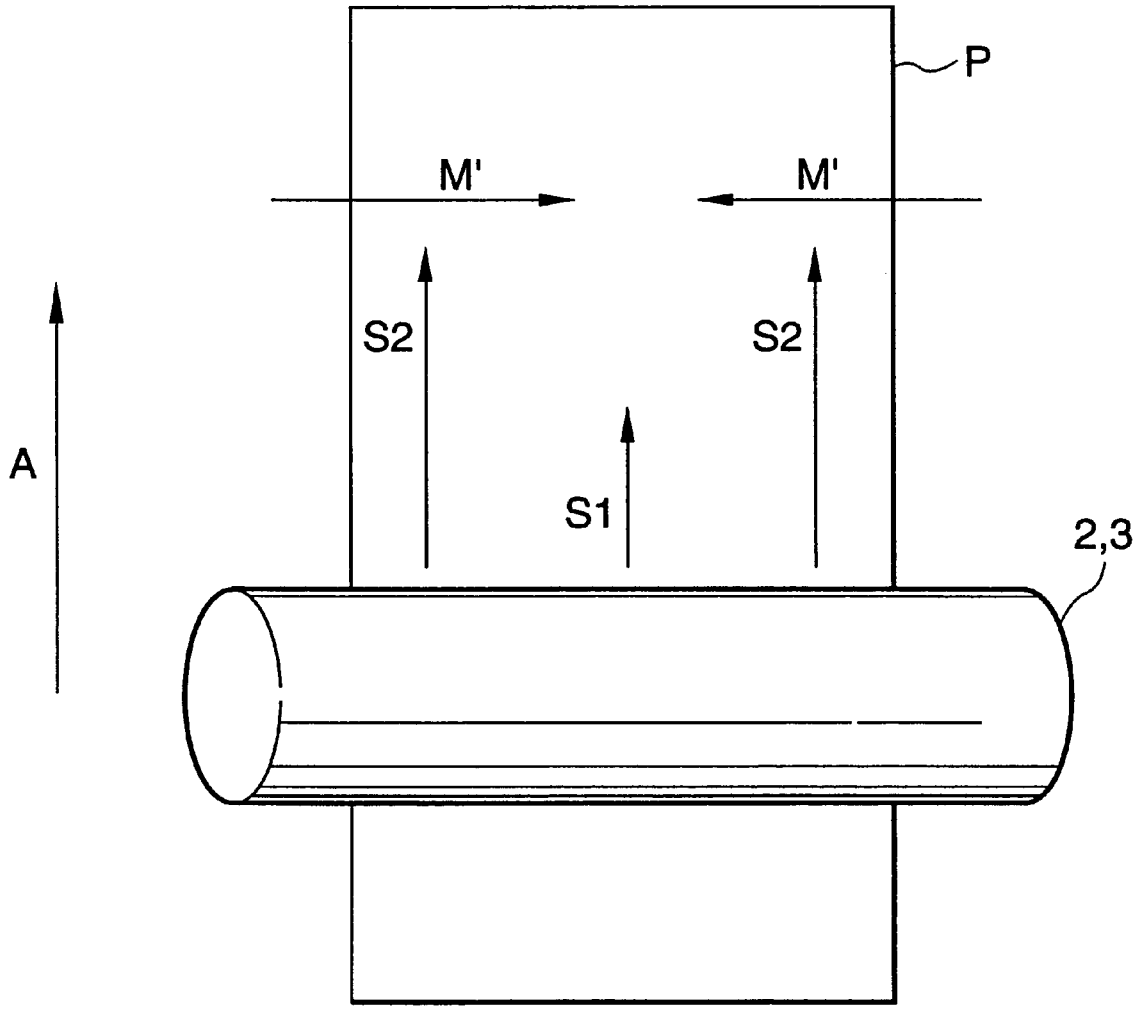
FIG.13 PRIOR ART
FIG. 13 is a schematic view showing the manner how wrinkles occur on a recording medium adopting the simultaneous transfer and fixing method in a conventional image forming apparatus.

In this manner, upon setting the nip shape index a/b to equal to or more than 0.8 by adjusting the ratio of compressive deformation of the surface layer of the pressure member at the central portion and at both end portions of a pair of pressure members, the speed difference of the recording medium at the central portion and at both end portions of the pressure members can be properly controlled so that the moment M which is directed inwardly (see FIG. 13) and is generated after making the recording medium pass through the nip region can be minimized and hence, it becomes possible to prevent the recording medium from being partially peeled off from the intermediate transfer body thus restricting the occurrence of wrinkles and the uneven brightness.

The second embodiment of the first image forming apparatus of the present invention is hereinafter explained.

Figure 5:
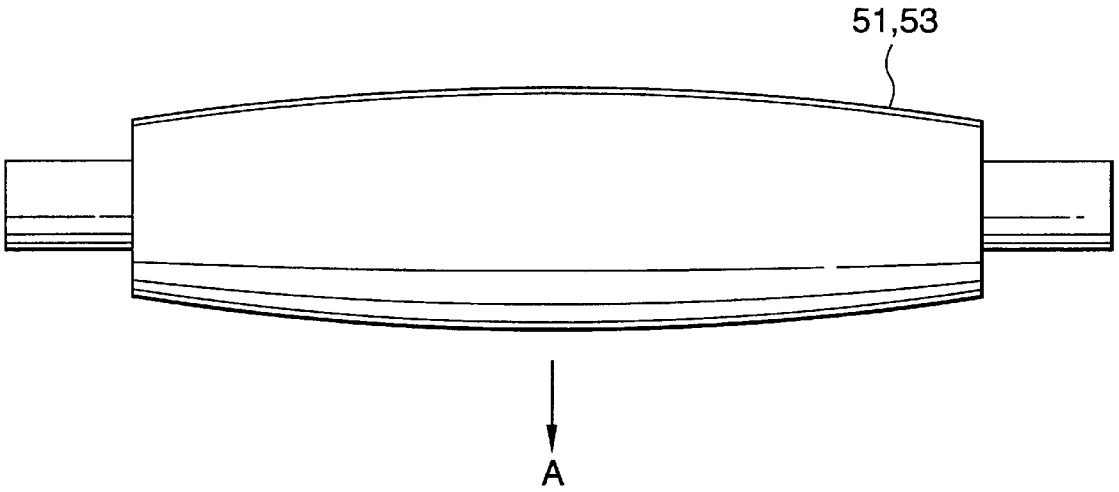
FIG. 5 is an explanatory view showing the shape of a pressure member of the second embodiment.

FIG. 5 is a view showing the shape of the pressure member of the second embodiment.

As shown in FIG. 5, a pair of rollers which are used in the second embodiment are made of a heating roller 51 and a pressure roller 53 and a pair of these rollers respectively have their outer diameter gradually increased from both end portions to the central portion along a roller axial direction.

Figure 11:
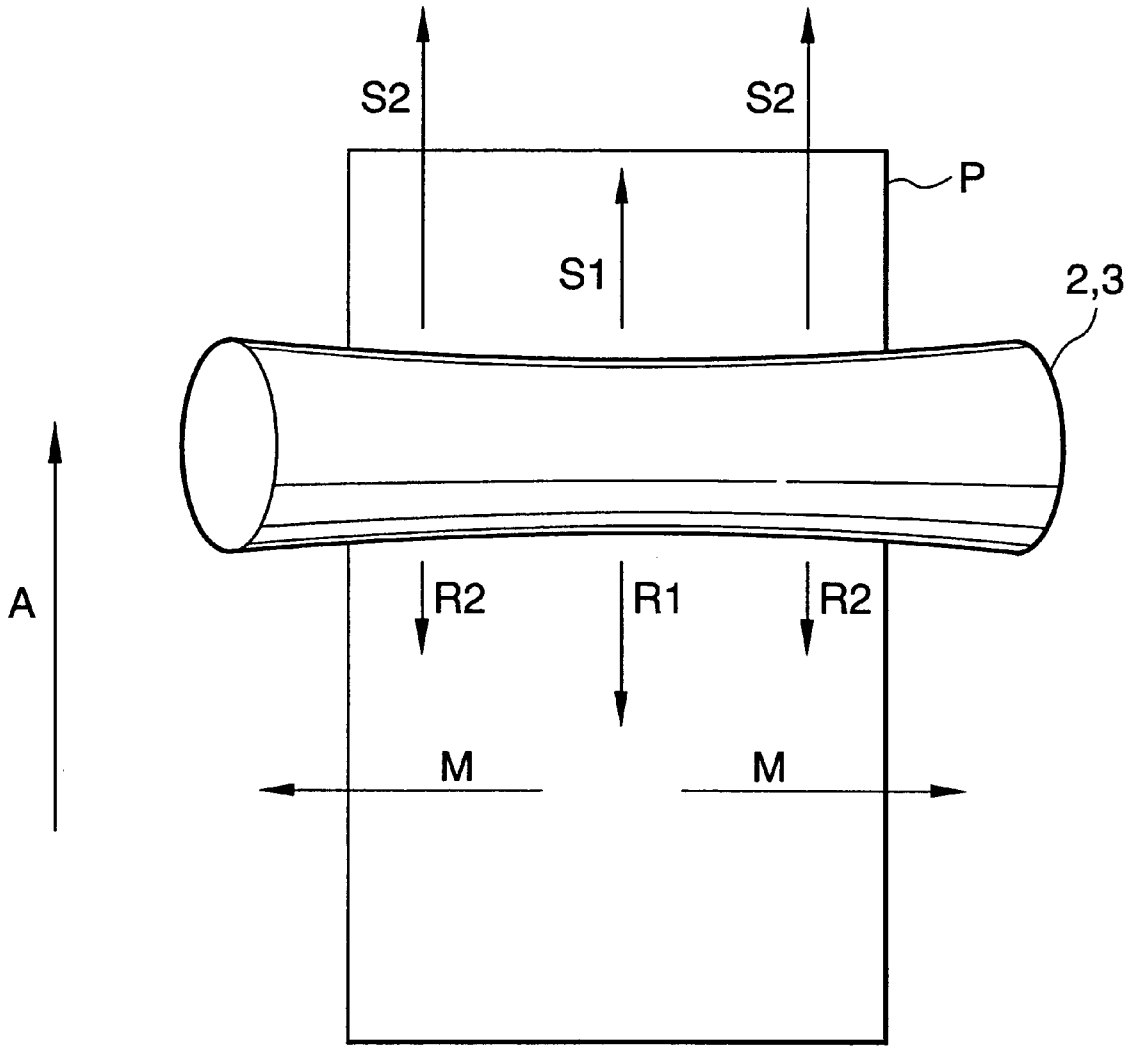
FIG.11 PRIOR ART
FIG. 11 is a schematic view showing the principle of the wrinkle prevention in a conventional fixing device.
Figure 12:
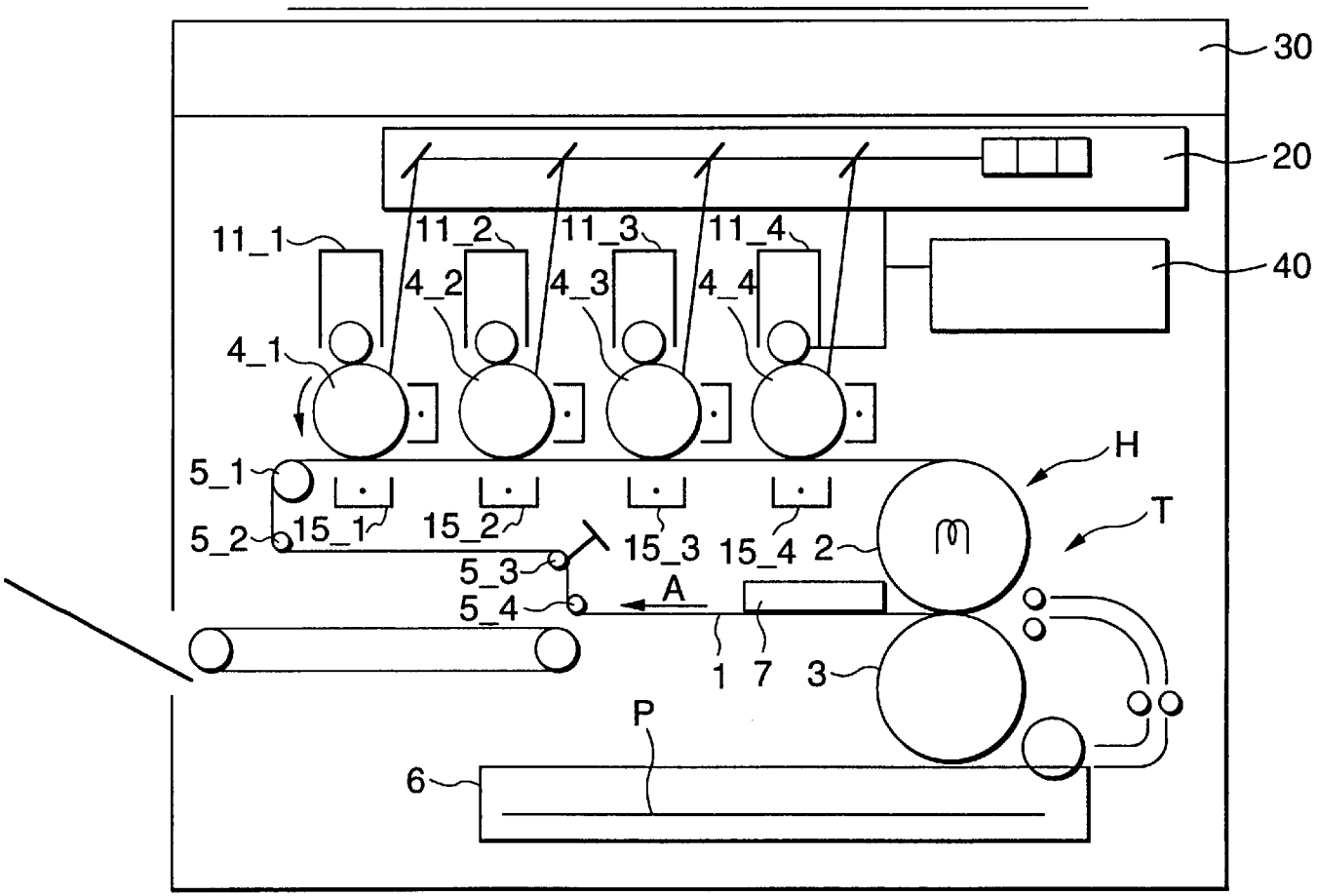
FIG.12 PRIOR ART
FIG. 12 is a schematic view of a conventional image forming apparatus adopting the simultaneous transfer and fixing method.

In case the rollers having such a shape are used and a given roller load is applied between a pair of rollers, the central portions of the rollers are deflected and the nip regions N which have the shape shown in FIG. 3(*c*) are formed. By setting the nip shape index a/b of the nip region N formed in the above manner to equal to or more than 0.8 as shown in FIG. 4, in the same manner as the transfer and fixing device as explained in conjunction with FIG. 11, the circumferential speed in the vicinity of both end portions of the nip region for the recording medium becomes faster than the circumferential speed in the vicinity of the central portion of the nip region. Accordingly, before the recording medium enters the nip region, a large resisting force which is directed in a direction opposite to the recording medium conveying direction A occurs in the vicinity of the central portion in a roller axial direction and a small resisting force occurs in the vicinity of both end portions of the recording medium in a roller axial direction. As a result, before the recording medium enters the nip region, the moment which works outwardly is applied to the recording medium and the recording medium enters the nip region while being stretched in a lateral direction so that no wrinkle occurs on the recording medium.

The third embodiment of the first image forming apparatus is explained hereinafter.

Figure 6:
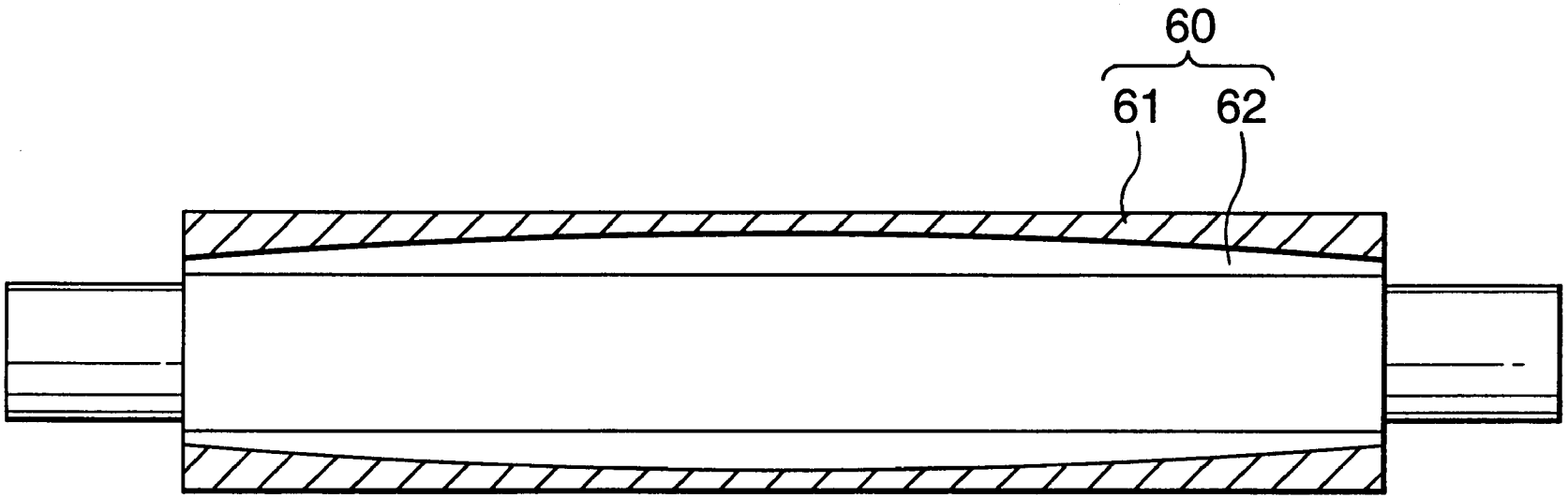
FIG. 6 is an explanatory view showing the shape of a pressure member of the third embodiment.

FIG. 6 shows the shape of the pressure member of the third embodiment.

As shown in FIG. 6, the pressure member is made of a laminated roller 60 where a resilient body layer 61 and a metal layer 62 are laminated in two layers and the metal layer 62 out of two layers has its layer thickness gradually increased from both end portions thereof to the central portion thereof.

In case the nip shape index a/b is set to equal to or more than 0.8 using this pressure member, by correcting the deflection of the roller and by adjusting the ratio of compressive deformation of the surface layer of the roller at the central portion and both end portions of the roller, the partial peeling-off of the recording medium from the intermediate transfer body can be prevented and hence, as shown in FIG. 4, it becomes possible to prevent the occurrence of wrinkle and the uneven brightness.

Figure 7A:
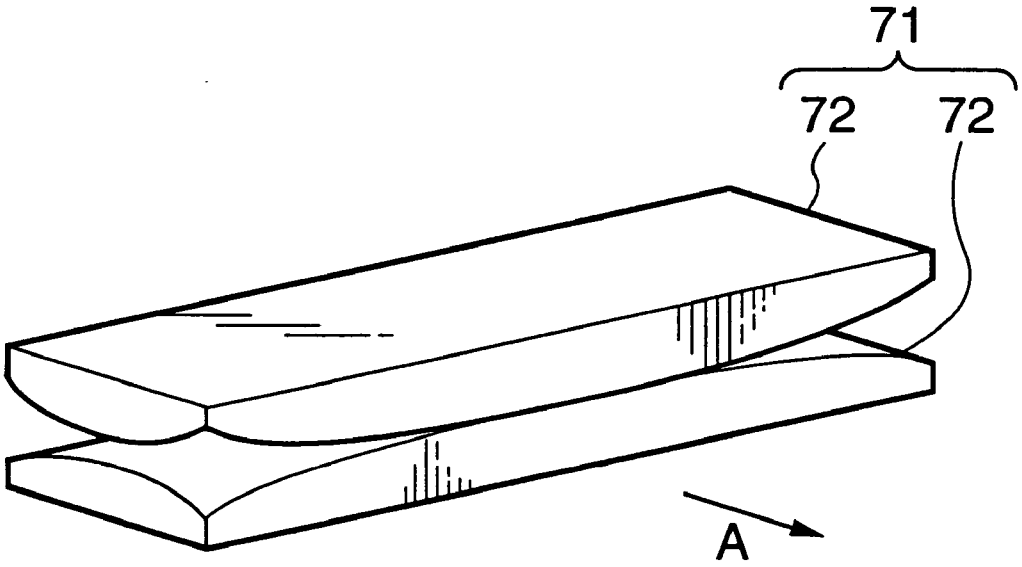
FIGS. 7(*a*) and 7(*b*) are an explanatory view showing an example which constructs a pair of pressure members of the present invention using a pair of plate members, and a view showing an example which constructs a pair of pressure members of the present invention using a combination of a plate member and a roller, respectively.
Figure 7B:
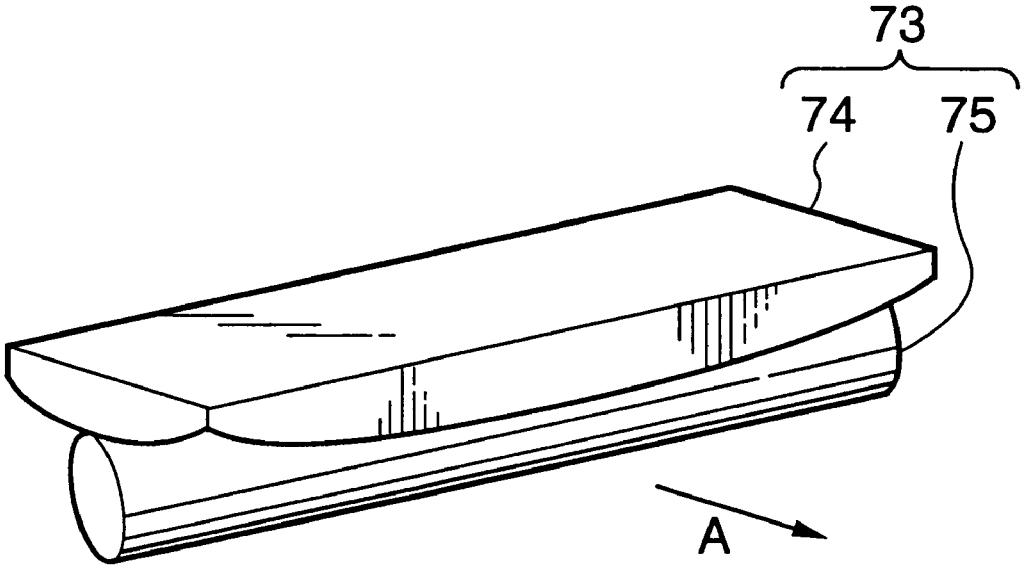

FIG. 7 shows an example in which a pair of pressure members are composed of a pair of plate-like members and an example in which a pair of pressure members are composed of a combination of a plate-like member and a roller.

As shown in FIG. 7(*a*), the pressure member 71 is composed of a pair of plate-like members 72, 72, while as shown in FIG. 7(*b*), the pressure member 73 is constructed by combining the plate-like member 74 and the roller 75. With respect to these pressure members 71, 73, at least one of a pair of pressure members is shaped in such a manner that it gradually bulges from both end portions to the central portion along a direction which intersects the intermediate transfer body moving direction A toward the other one of a pair of pressure members. Using such pressure members 71, 73 and setting the nip shape index a/b of the nip region defined by the pressure members 71, 73 to equal to or more than 0.8, the occurrence of wrinkle can be prevented as shown in FIG. 4.

The image forming apparatus of the second image forming apparatus of the present invention is hereinafter explained.

Figure 8:
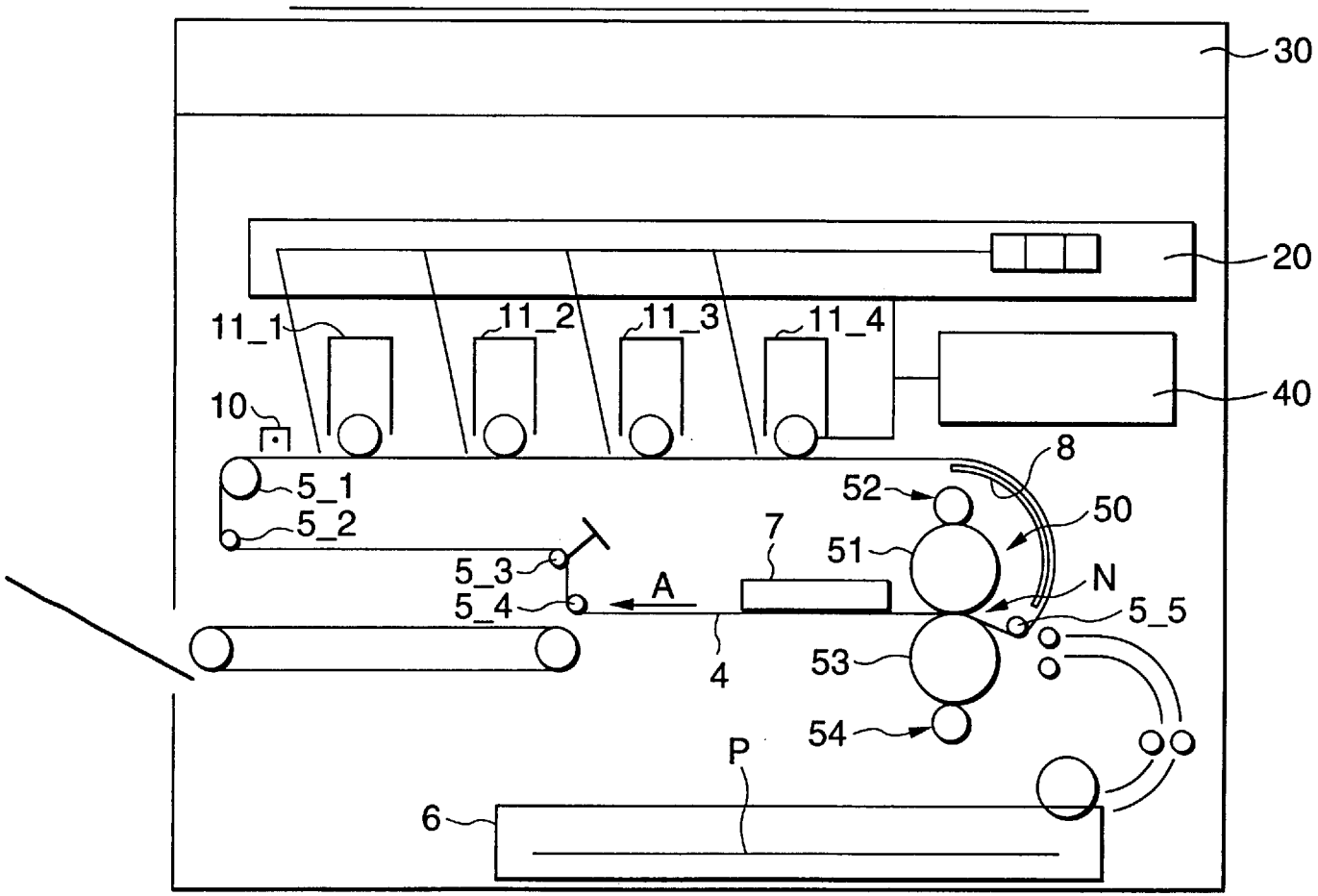
FIG. 8 is a schematic structural view of one embodiment of the second image forming apparatus of the present invention.
Figure 9A:
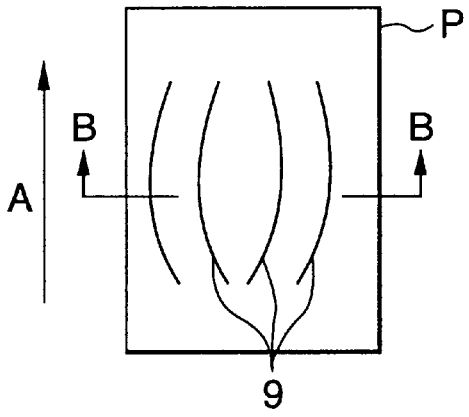
FIG.9(a) PRIOR ART
FIGS. 9(*a*) and 9(*b*) are a plane view showing the condition where the wrinkles are generated on the recording medium after heating and pressing using the conventional transfer and fixing device and its cross-sectional view taken along a line B—B, respectively.
Figure 9B:
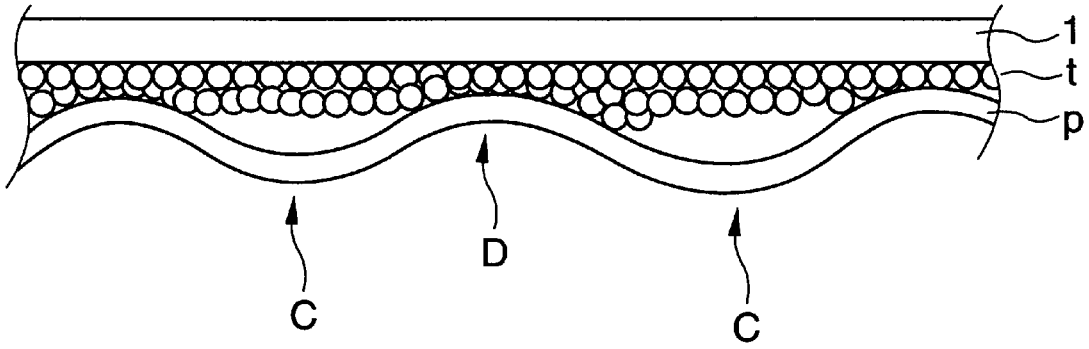
FIG.9(b) PRIOR ART
Figure 10:
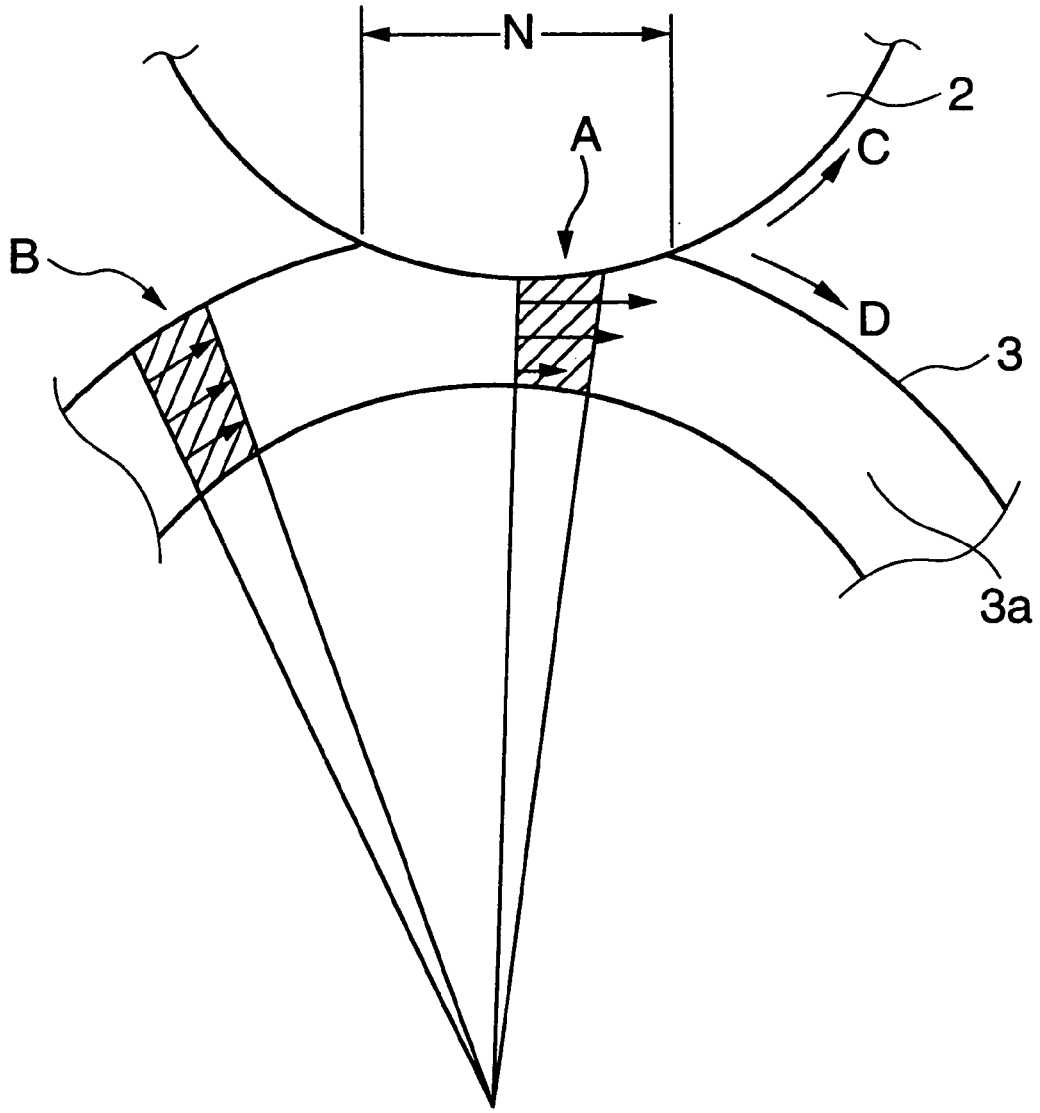
FIG.10 PRIOR ART
FIG. 10 is a schematic view showing a nip region formed by a pair of rollers having resilient layers.

FIG. 8 is a schematic structural view showing the image forming apparatus of one embodiment of the second aspect of the present invention.

As shown in FIG. 8, different from the first image forming apparatus of the present invention, the image forming apparatus of this embodiment is not provided with the drum-shaped photosensitive bodies and the intermediate transfer body having an endless belt shape. The image forming apparatus, however, is provided with a photosensitive body having an endless belt shape instead of these components. The photosensitive body belt 4 is supported by rollers 5_1, 5_2, 5_5, a tension roller 5_3, a peeling-off roller 5_4 and a heating plate 8 and carries out a circulation movement in a direction of an arrow A. Only one charging device 10 is provided for uniformly charging the photosensitive body belt 4. Except for the above-mentioned construction, the image forming apparatus of this embodiment has the similar construction as that of the first embodiment of the first aspect of the present invention. The construction of the image forming apparatus which differ from that of the first embodiment of the first aspect of the present invention is exclusively explained hereinafter.

The photosensitive body belt 4 is uniformly charged by the charging device 10 and thereafter, the photosensitive body belt 4 is exposed by means of the optical scanning device 20 which is turned on or off by the light beam pulse width modulation device in response to a concentration signal corresponding to black outputted from the image signal processing device 40 based on the image information from the image reading device 30 so that an electrostatic latent image which corresponds to black can be formed on the photosensitive body belt 4. The electrostatic latent image which corresponds to black is developed by the developer 11_1 which stores the black toner therein. The black toner image made of a so-called digital image which expresses the concentration by the area modulation is formed on the photosensitive body belt 4. Subsequently, on the black toner image formed on the photosensitive body belt 4, an electrostatic latent image corresponding to yellow is formed and then the electrostatic latent image is developed by the developer 11_2 to form the yellow toner image. Furthermore, toner images of magenta and cyan are formed on the photosensitive body belt 4 in sequence in an overlapped manner to form a multicolor toner image on the photosensitive body belt 4.

The multicolor toner image formed on the photosensitive body belt 4 is brought into contact with the heating plate 8 and hence, is heated and fused. Since the transfer and fixing step carried out by the transfer and fixing device 50 and other ensuing steps are similar to those steps of the image forming apparatus of the first aspect of the present invention shown in FIG. 1, the explanation of these steps are omitted.

As the photosensitive body belt 4, various inorganic photosensitive bodies being made of Se, α-Si, α-Sic, CdS or the like and having a favorable heat resistance can be used.

Subsequently, the result of the image forming test carried out by using this image forming apparatus is explained hereinafter.

As the heating roller 51 and the pressure roller 53, a roller which covers the surface of a metallic roller having an outer diameter of 50 mm with a surface layer having a thickness of 2 mm and a rubber hardness of 30 was used. The roller was also adjusted such that the outer diameter of the central portion of the metallic roller is larger than the outer diameter of both end portions of the metallic roller by 800 μm so as to set the nip shape index a/b to 0.9.

The remaining test conditions are similar to those of the first embodiment of the first image forming apparatus of the present invention.

Under the above-mentioned conditions, 100 sheets of the ordinary paper (J paper), the thin paper (S paper) and thick paper (Shiraoi paper) were respectively outputted as image and evaluation was carried out on the paper wrinkles and uneven brightness. The result turned out to be favorable in all cases, wherein the evaluation grade was G0 in all cases and good images free from wrinkle and uneven brightness were obtained.

As has been explained heretofore, according to the transfer and fixing device and the image forming apparatus equipped with the transfer and fixing device of the present invention, the transfer and fixing device capable of simultaneously carrying out the transferring and fixing and the image forming apparatus which can obtain the high quality image exhibiting high luster, favorable color balancing and excellent toner transparency can be realized. Furthermore, according to the image forming method of the present invention, the high quality image exhibiting high luster, favorable color balancing and excellent toner transparency can be realized.

What is claimed is:

1. An image forming apparatus comprising:

an image carrier of an endless belt shape which carries out a circulation movement in a given moving direction;

a toner image forming device for forming a toner image on said image carrier; and a transfer and fixing device which includes a pair of pressure members which overlap said toner image formed on said image carrier and a given recording medium and then press them while heating thus transferring and fixing said toner image on said image carrier to said recording medium, said pair of pressure members defining a nip region where said pair of pressure members press each other and the ratio a/b between the length a of said nip region in an image carrier moving direction at the central portion of said pressure members and the length b of said nip region in said image carrier moving direction at both end portions of said pressure members is set to be more than 0.8.

2. An image forming apparatus comprising:

a photosensitive body having an endless belt shape which carries out a circulation movement in a given moving direction;

an electrostatic latent image forming apparatus which forms an electrostatic latent image on said photosensitive body based on image information;

a developing device developing said electrostatic latent image formed on said photosensitive body with a toner thus forming a toner image on said photosensitive body; and a transfer and fixing device which includes a pair of pressure members which overlap said photosensitive body which carriers said toner image formed by said developing device and a given recording medium and presses them while heating thus transferring and fixing said toner image on said photosensitive body to said recording medium, said pair of pressure members defining a nip region where said pair of pressure members press each other and ratio a/b between the length a of said nip region in a photosensitive body moving direction at the central portion of said pressure members and the length b of said nip region in the photosensitive body moving direction at both end portions of said pressure members is set to be more than 0.8.

3. An image forming apparatus according to claim 1, wherein at least one pressure member of said pair of pressure members is gradually bulged toward the other pressure member from both end portions to the central portion.

4. An image forming apparatus according to claim 1, wherein said apparatus further includes a pressing device which presses the central portion of at least one of said pressure members toward said other pressure member from the side which is opposite to the side which comes into contact with said other pressure member.

5. An image forming apparatus according to claim 1, wherein at least one pressure member out of a pair of said pressure members is a roller.

6. An image forming apparatus according to claim 5, wherein said roller is formed in a shape which gradually increases the outer diameter from both end portions to the central portion in a roller axial direction.

7. An image forming apparatus according to claim 5, wherein said roller is a laminated roller on which a plurality of layers are laminated and at least one layer out of a plurality of said layers has the layer thickness of the central portion thereof in a roller axial direction made thicker than the layer thickness of both end portions thereof in said roller axial direction.

8. An image forming apparatus according to claim 5, wherein said image forming apparatus is provided with a pressing device which comes into contact with a roller surface of a roller which constitutes one of a pair of said pressure members with said roller surface disposed opposite to the side which comes into contact with the other pressure member which forms a pair with said roller, and said pressing device presses said roller to said other pressure member.

9. A transfer and fixing device comprising:

a pair of pressure members which overlaps a toner image carried on an endless belt which carries out a circulation movement in a given moving direction and a given recording medium and press them while heating so as to transfer and fix said toner image on said endless belt to said recording medium, said pair of pressure members defining a nip region where said pressure members press each other and the ratio a/b between the length a of said nip region in said moving direction at the central portion of said pressure members and the length b of said nip region in said moving direction at both end portions of said pressure members is set to be more than 0.8.

10. A transfer and fixing device according to claim 9, wherein at least one pressure member of a pair of said pressure members is gradually bulged toward the other pressure member from both end portions to the central portion.

11. A transfer and fixing device according to claim 9, wherein said apparatus further includes a pressing device which presses the central portion of at least one of said pressure members toward said other pressure member from the side which is opposite to the side which comes into contact with said other pressure member.

12. A transfer and fixing device according to claim 9, wherein at least one pressure member out of a pair of said pressure members is a roller.

13. A transfer and fixing device according to claim 12, wherein said roller is formed in a shape which gradually increases the outer diameter from both end portions to the central portion in a roller axial direction.

14. A transfer and fixing device according to claim 12, wherein said roller is a laminated roller on which a plurality of layers are laminated and at least one layer out of a plurality of said layers is a layer which has the layer thickness thereof gradually increased from both end portions thereof to central portion thereof in said roller axial direction.

15. A transfer and fixing device according to claim 12, wherein said transfer and fixing device is provided with a pressing device which comes into contact with a roller surface of a roller which constitutes one of a pair of said pressure members with said roller surface disposed opposite to the side which comes into contact with the other pressure member which forms a pair with said roller, and said pressing device presses said roller to said other pressure member.

16. An image forming method comprising:

a toner image forming step in which a toner image is formed on an endless belt which holds said toner image on a surface thereof and carries out a circulation movement in a given direction; and a transfer and fixing step using a transfer device equipped with a pair of pressure members, in which said toner image formed on said endless belt and a given recording medium are overlapped and pressed each other while being heated so as to transfer and fix said toner image on said endless belt to said recording medium, and the ratio a/b between the length a in said moving direction of a nip region where said pair of pressure members press each other at the central portion of said pressure members and the length b of said nip region at both end portions of said pressure members is set to be more than 0.8.

17. An image forming apparatus according to claim 1, wherein the ratio a/b is set to be 0.83 to 0.93.

18. An image forming apparatus according to claim 2, wherein the ratio a/b is set to be 0.83 to 0.93.

19. A transfer and fixing device according to claim 9, wherein the ratio a/b is set to be 0.83 to 0.93.

20. An image forming method according to claim 16, wherein the ration a/b is set to be 0.83 to 0.93.

* * * * *